US009835997B2

(12) United States Patent
Tsuru

(10) Patent No.: US 9,835,997 B2
(45) Date of Patent: Dec. 5, 2017

(54) IMAGE FORMING APPARATUS HAVING CONVEYANCE ROLLER SECTION WITH NIP ANGLE ADJUSTING SECTION

(71) Applicant: Konica Minolta, Inc., Tokyo (JP)

(72) Inventor: Kenji Tsuru, Aichi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/801,379

(22) Filed: Jul. 16, 2015

(65) Prior Publication Data

US 2016/0026134 A1 Jan. 28, 2016

(30) Foreign Application Priority Data

Jul. 25, 2014 (JP) ..... 2014-152246

(51) Int. Cl.
*G03G 15/00* (2006.01)
*G03G 15/20* (2006.01)
(Continued)

(52) U.S. Cl.
CPC ..... *G03G 15/2085* (2013.01); *B65H 5/068* (2013.01); *B65H 5/26* (2013.01);
(Continued)

(58) Field of Classification Search
CPC ..... G03G 15/6576; G03G 2215/00662; B65H 2404/1421
See application file for complete search history.

(56) References Cited

U.S. PATENT DOCUMENTS 5,806,992 A * 9/1998 Ju ..... G01B 21/08 250/559.27
6,259,888 B1 * 7/2001 Kazama ..... B65H 29/12 271/183
(Continued)

FOREIGN PATENT DOCUMENTS

JP H10-319647 A 12/1998
JP 2000281257 A1 10/2000
(Continued)

OTHER PUBLICATIONS

Notice of Reasons for Rejection dated Sep. 27, 2016 from corresponding Japanese Application; Japanese Patent Application No. 2014-152246; Translation of Notice of Reasons for Rejection; Total of 9 pages.

*Primary Examiner* — Justin Olamit
(74) *Attorney, Agent, or Firm* — Lucas & Mercanti, LLP

(57) ABSTRACT

An image forming apparatus includes: a toner image forming section; a transfer section; a fixing section; a conveyance roller section disposed on a downstream side of the fixing section in a sheet conveyance direction; a conveyance guide section disposed on a downstream side of the conveyance roller section and including a first guide member disposed on a fixing side of a sheet and a second guide member disposed on a rear surface side of the sheet; a feeding-path-switching section disposed on a downstream side of the conveyance guide section and configured to switch sheet feeding paths; and a nip angle adjusting section configured to change a nip angle of a conveyance nip in accordance with whether a sheet on which an image is formed on a first surface thereof is conveyed, or a sheet on which an image is formed on a second surface thereof is conveyed.

6 Claims, 8 Drawing Sheets

(51) Int. Cl.

| | |
|---|---|
| ***B65H 5/06*** | (2006.01) |
| ***B65H 5/26*** | (2006.01) |
| ***B65H 29/58*** | (2006.01) |
| ***G03G 15/23*** | (2006.01) |
| ***B65H 29/12*** | (2006.01) |
| ***B65H 85/00*** | (2006.01) |

(52) U.S. Cl.

CPC ..... *B65H 29/12* (2013.01); *B65H 29/58* (2013.01); *B65H 85/00* (2013.01); *G03G 15/234* (2013.01); *G03G 15/6573* (2013.01); *G03G 15/6576* (2013.01); *B65H 2301/132* (2013.01); *B65H 2404/1421* (2013.01); *B65H 2404/632* (2013.01); *B65H 2511/21* (2013.01); *B65H 2513/10* (2013.01); *B65H 2515/112* (2013.01); *B65H 2801/06* (2013.01); *G03G 15/6579* (2013.01); *G03G 2215/00586* (2013.01); *G03G 2215/00704* (2013.01); *G03G 2215/2083* (2013.01)

(56) References Cited

U.S. PATENT DOCUMENTS

| | | | | |
|---|---|---|---|---|
| 8,588,674 | B2 * | 11/2013 | Nanayama | G03G 15/231<br>271/188 |
| 8,634,751 | B2 * | 1/2014 | Moteki | G03G 15/657<br>399/322 |
| 8,824,954 | B2 * | 9/2014 | Nishimura | G03G 15/6576<br>399/397 |
| 9,031,492 | B2 * | 5/2015 | Oohara | G03G 15/6576<br>399/406 |
| 9,075,379 | B2 * | 7/2015 | Egawa | G03G 15/6576 |

FOREIGN PATENT DOCUMENTS

| | | | |
|---|---|---|---|
| JP | 2003270995 | A | 9/2003 |
| JP | 2008179442 | A | 8/2008 |

* cited by examiner

IMAGE FORMING APPARATUS HAVING CONVEYANCE ROLLER SECTION WITH NIP ANGLE ADJUSTING SECTION

CROSS REFERENCE TO RELATED APPLICATIONS

This application is entitled to and claims the benefit of Japanese Patent Application No. 2014-152246, filed on Jul. 25, 2014, the disclosure of which including the specification, drawings and abstract is incorporated herein by reference in its entirety.

BACKGROUND OF THE INVENTION

1. Field of the Invention

The present invention relates to an electrophotographic image forming apparatus.

2. Description of Related Art

In general, an electrophotographic image forming apparatus (such as a printer, a copy machine, and a fax machine) is configured to irradiate (expose) a uniformly-charged photoconductor (for example, a photoconductor drum) with (to) laser light based on image data to form an electrostatic latent image on the surface of the photoconductor. The electrostatic latent image is then visualized by supplying toner from a developing device to the photoconductor on which the electrostatic latent image is formed, whereby a toner image is formed. Further, the toner image is directly or indirectly transferred to a sheet through an intermediate transfer belt, followed by heating and pressurization for fixing at a fixing section, whereby an image is formed on the sheet.

In such an image forming apparatus, as illustrated in FIG. 1A and FIG. 1B for example, conveyance roller section 31 having a pair of rollers 31A and 31B is disposed on the downstream side of fixing section 23 in the sheet conveyance direction, and further, conveyance guide section 32 is disposed on the downstream side of conveyance roller section 31 in the sheet conveyance direction. Conveyance guide section 32 includes first guide member 32A (for example, upper side guide member) disposed on the fixing surface side of a sheet and second guide member 32B (for example, lower side guide member) disposed on the rear surface side. A sheet that has passed through fixing section 23 is output by conveyance roller section 31, and is conveyed along a sheet feeding path defined by conveyance guide section 32.

In addition, in an image forming apparatus that can form images on both sides of a sheet, switch-back conveyance section 162 for conveying a sheet to a rear surface printing conveyance section is provided continuously with second guide member 32B, and the sheet feeding paths are switched by feeding-path-switching section 164. FIG. 1A illustrates a sheet feeding path for the case where a sheet is ejected out of the apparatus, and FIG. 1B illustrates a sheet feeding path for the case where a duplex image formation is performed.

Typically, conveyance roller section 31 is disposed such that a sheet being output is substantially parallel to second guide member 32B regardless of one-side image formation or duplex image formation. Here, angle θ of tangential direction L of a conveyance nip formed by a pair of rollers 31A and 31B to second guide member 32B is referred to as "nip angle" (see FIGS. 2A and 2B). That is, nip angle θ is an angle between perpendicular P of second guide member 32B and line M that connects the axial centers of rollers 31A and 31B. Typically, nip angle θ of conveyance roller section 31 is set to 0° as illustrated in FIG. 2B.

Incidentally, in fixing section 23, the temperature of a fixing side member is higher than the temperature of a back side supporting member, and therefore a protruding curl is easily formed on the fixing surface side (on first guide member 32A side) of a sheet after the fixation. In this case, there is a risk that the sheet image formation surface makes contact with first guide member 32A. When a sheet that has passed through fixing section 23 makes contact with the conveyance surface of first guide member 32A, the image formation surface is chipped by burrs of a resin rib and a sheet metal, and consequently scratch may possibly be left in the image. In particular, scratch is easily caused in the field of production print where image formation is continuously performed with high speed.

Conventionally, scratch has been avoided by disposing a conveyance roller that rotates to follow the conveyance of sheets and protrudes into the sheet feeding path relative to the conveyance surface in the first guide member and the second guide member (for example, Japanese Patent Application Laid-Open Nos. 2003-270995 and 2008-179442). In addition, Japanese Patent Application Laid-Open No. 10-319647 discloses a technique in which, in the case where a sheet is output to a rear surface printing conveyance section after fixation to perform duplex image formation, the nip angle of the conveyance roller section is changed to moderate the angle of the sheet entering the feeding-path-switching section (switching gate).

In the following, a surface on which an image is formed in one-side image formation or a surface on which an image is firstly formed in duplex image formation is referred to as "first surface," and the rear surface of the first surface is referred to as "second surface."

As disclosed in Japanese Patent Application Laid-Open Nos. 2003-270995 and 2008-179442, it is effective to dispose a conveyance roller in the sheet feeding path to deal with the scratch problem. However, the image forming apparatus may not have the space for disposing the conveyance roller. In addition, even if the space for disposing the conveyance roller is secured, jam and corner folding of sheets are easily caused since the angle of the sheet entering the conveyance roller is great, and therefore installation of the conveyance roller may not always be preferable.

In addition, the technique disclosed in Japanese Patent Application Laid-Open No. 10-319647 is intended to cause sheets to smoothly enter the feeding-path-switching section, and is not useful for preventing scratch. Specifically, since the nip angle is changed to the direction in which the impact of the contact between the first surface of the sheet and the first guide member is increased, it can be said that scratch is caused more easily.

SUMMARY OF THE INVENTION

An object of the present invention is to provide an image forming apparatus which can limit scratch, and can create high-quality images without disposing a conveyance roller in a sheet feeding path.

To achieve the abovementioned object, an image forming apparatus reflecting one aspect of the present invention includes: a toner image forming section configured to form a toner image on an image bearing member; a transfer section configured to transfer a toner image formed on the image bearing member to a sheet; a fixing section configured to fix a toner image transferred to a sheet by the transfer section; a conveyance roller section including a pair of rollers, and disposed on a downstream side of the fixing section in a sheet conveyance direction; a conveyance guide section disposed on a downstream side of the conveyance roller section in the sheet conveyance direction, and including a first guide member disposed on a fixing side of a sheet and a second guide member disposed on a rear surface side of the sheet; a feeding-path-switching section disposed on a downstream side of the conveyance guide section in the sheet conveyance direction, and configured to switch between a first sheet feeding path and a second sheet feeding path, the first sheet feeding path being configured to output a sheet from the apparatus, the second sheet feeding path being configured to output a sheet to a rear surface printing conveyance section provided continuously with the second guide member; and a nip angle adjusting section configured to change a nip angle of a conveyance nip formed by the pair of rollers in accordance with whether a sheet on which an image is formed on a first surface thereof is conveyed, or a sheet on which an image is formed on a second surface thereof is conveyed.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1A:
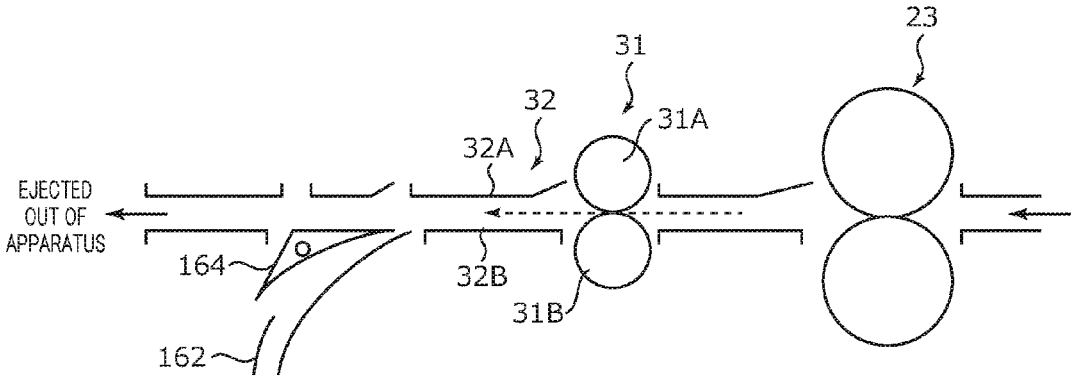
FIG. 1A Prior Art
FIG. 1A and FIG. 1B illustrate a sheet feeding path on a downstream side in a sheet conveyance direction of a fixing section.
Figure 1B:
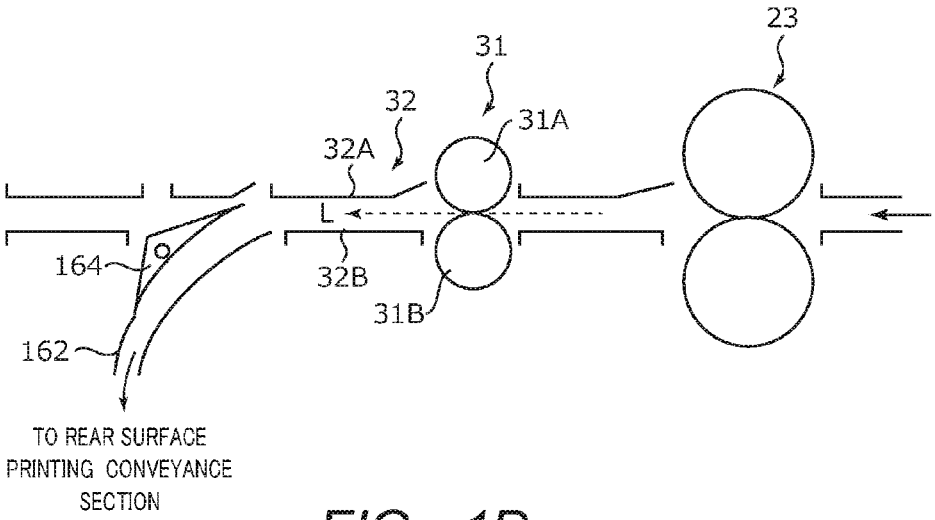
FIG. 1B Prior Art
Figure 2A:
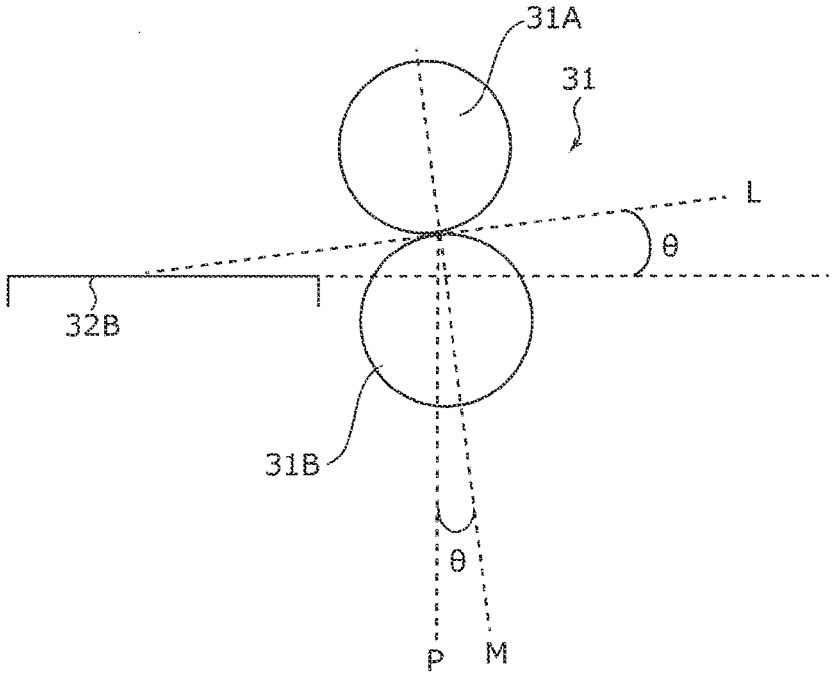
FIG. 2A and FIG. 2B illustrate a nip angle of a conveyance roller section.
Figure 2B:
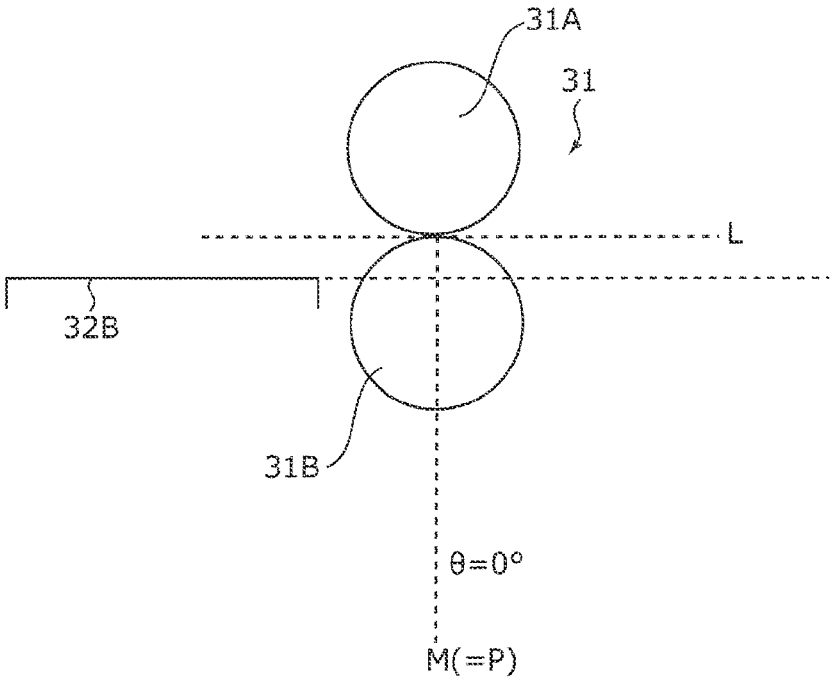

In the following, the embodiment of the present invention is described referring to the drawings.

Figure 3:
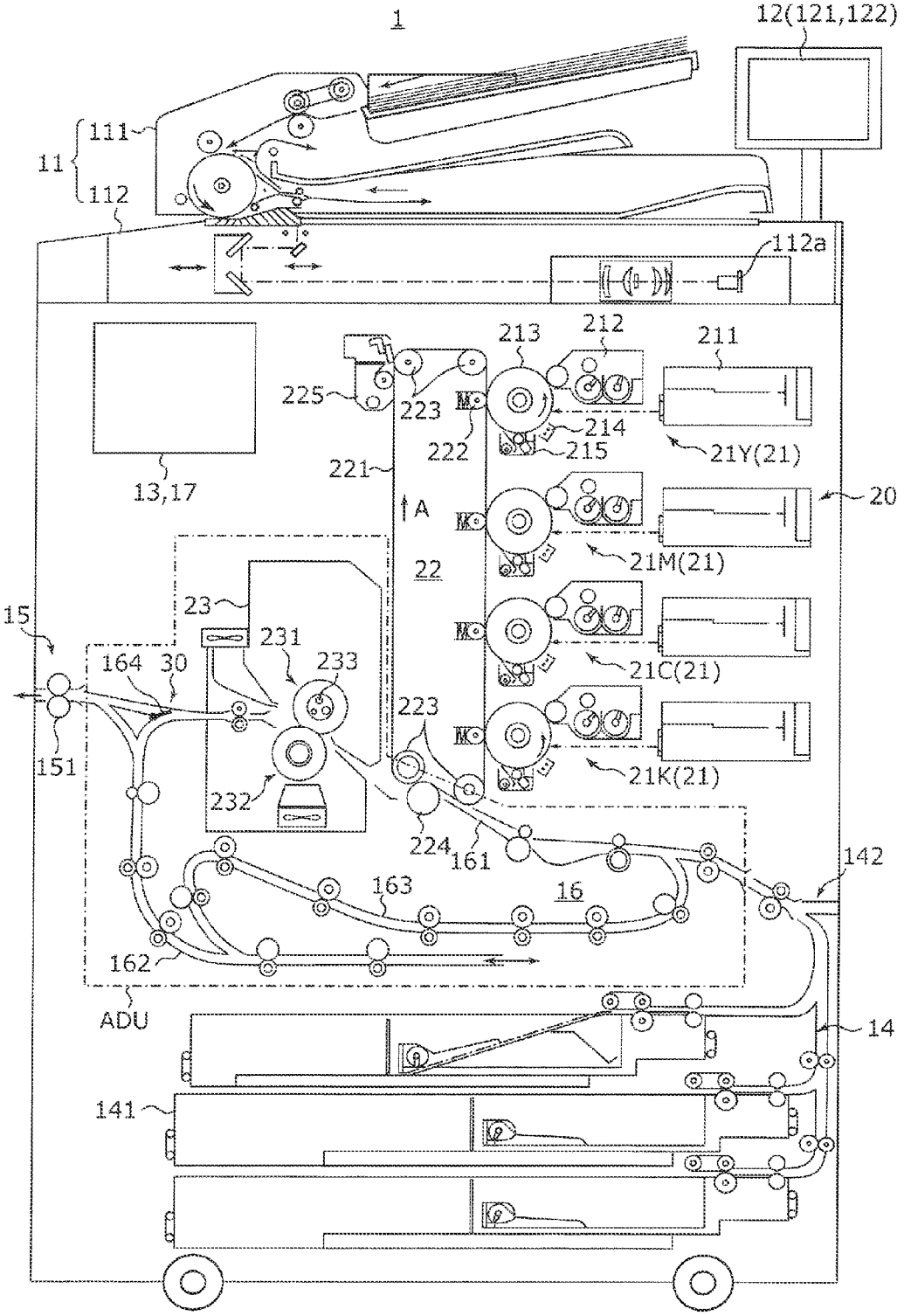
FIG. 3 illustrates a general configuration of an image forming apparatus.
Figure 4:
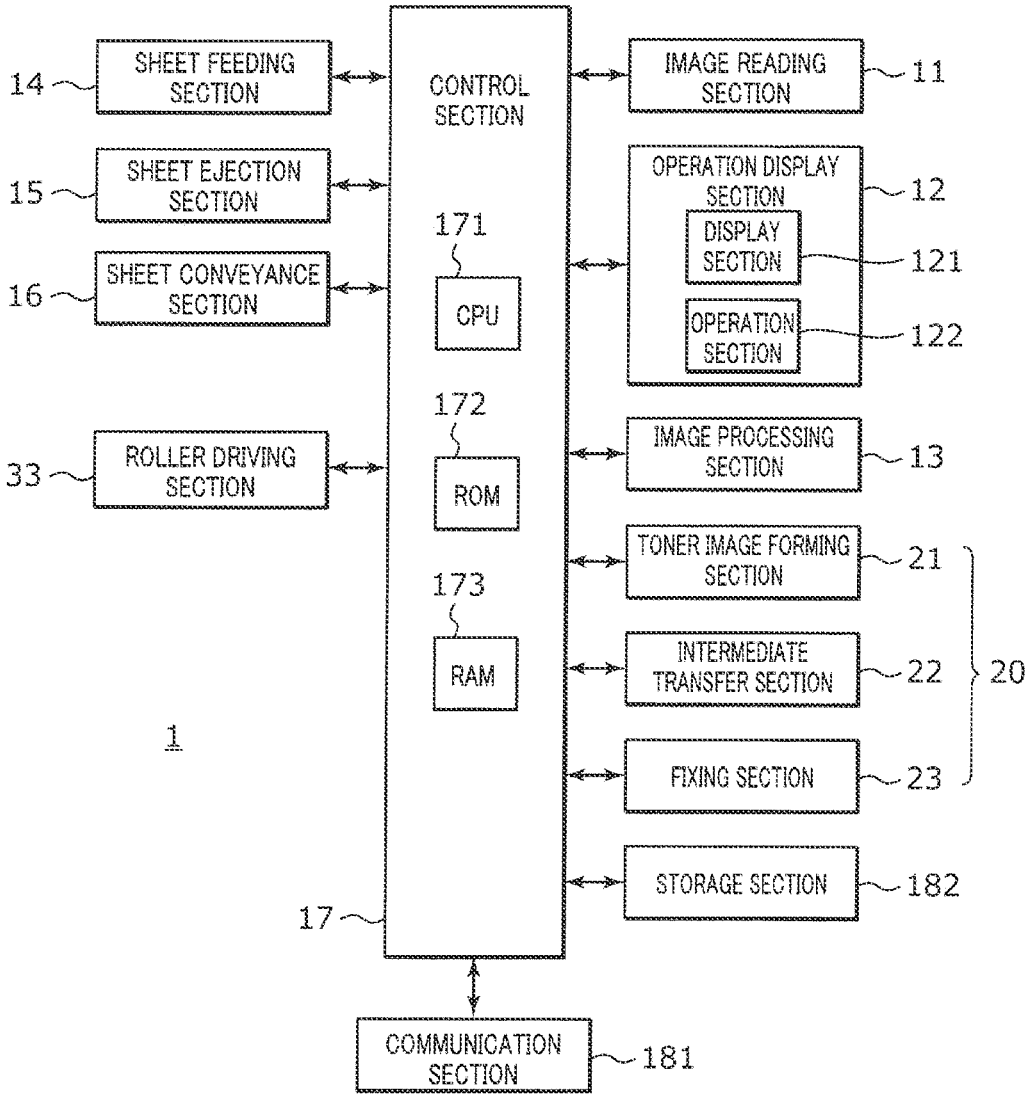
FIG. 4 illustrates a principal part of a control system of the image forming apparatus.

FIG. 3 illustrates a general configuration of image forming apparatus 1. FIG. 4 illustrates a principal part of a control system of image forming apparatus 1.

Image forming apparatus 1 illustrated in FIGS. 3 and 4 is a color image forming apparatus of an intermediate transfer system using electrophotographic process technology. A longitudinal tandem system is adopted for image forming apparatus 1. In the longitudinal tandem system, respective photoconductor drums 213 corresponding to the four colors of YMCK are placed in series in the travelling direction (vertical direction) of intermediate transfer belt 221, and the toner images of the four colors are sequentially transferred to intermediate transfer belt 221 in one cycle.

That is, image forming apparatus 1 transfers (primary-transfers) toner images of yellow (Y), magenta (M), cyan (C), and black (K) formed on photoconductor drums 213 to intermediate transfer belt 221, and superimposes the toner images of the four colors on one another on intermediate transfer belt 221. Then, image forming apparatus 1 secondary-transfers the resultant image to a sheet, thereby forming an image.

As illustrated in FIGS. 3 and 4, image forming apparatus 1 includes image reading section 11, operation display section 12, image processing section 13, image forming section 20, sheet feeding section 14, sheet ejection section 15, sheet conveyance section 16, and control section 17.

Control section 17 includes central processing unit (CPU) 171, read only memory (ROM) 172, random access memory (RAM) 173 and the like. CPU 171 reads a program suited to processing details out of ROM 172 or storage section 182, develops the program in RAM 173, and integrally controls an operation of each block of image forming apparatus 1 in cooperation with the developed program.

Communication section 181 has various interfaces such as network interface card (NIC), modulator-demodulator (MODEM), and universal serial bus (USB), for example. Storage section 182 is composed of, for example, a non-volatile semiconductor memory (so-called flash memory) or a hard disk drive.

Storage section 182 stores therein a look-up table which is referenced when the operation of each block is controlled, for example.

Control section 17 transmits and receives various data to and from an external apparatus (for example, a personal computer) connected to a communication network such as a local area network (LAN) or a wide area network (WAN), through communication section 181. Control section 17 receives image data (input image data) of page description language (PDL) that has been sent from an external device, and controls the apparatus to form an image on a sheet on the basis of the data, for example.

Image reading section 11 includes an automatic document feeder 111 called auto document feeder (ADF), document image scanner (scanner) 112, and the like.

Auto document feeder 111 causes a conveyance mechanism to feed documents placed on a document tray, and sends out the documents to document image scanner 112. Auto document feeder 111 enables images (even both sides thereof) of a large number of documents placed on the document tray to be successively read at once.

Document image scanner 112 optically scans a document fed from auto document feeder 111 to its contact glass or a document placed on its contact glass, and images light reflected from the document on the light receiving surface of charge coupled device (CCD) sensor 112*a*, to thereby read the document image. Image reading section 11 generates input image data on the basis of a reading result provided by document image scanner 112. Image processing section 13 performs predetermined image processing on the input image data.

Operation display section 12 includes, for example, a liquid crystal display (LCD) with a touch panel, and functions as display section 121 and operation section 122. Display section 121 displays various operation screens, image conditions, operating statuses of functions, and the like in accordance with display control signals received from control section 17. Operation section 122 includes various operation keys such as numeric keys and a start key, receives various input operations performed by a user, and outputs operation signals to control section 17.

By operating operation display section 12, the user can perform setting relating to the image formation such as document setting, image quality setting, multiplying factor setting, application setting, output setting, single-sided/duplex printing setting, and sheet setting (including the basis weight of the sheet, and presence of gloss). The information thus set is stored in storage section 182 for example.

Image processing section 13 includes a circuit that performs a digital image process suited to initial settings or user settings on the input image data, and the like. For example, image processing section 13 performs tone correction on the basis of tone correction data under the control of control section 17. Image processing section 13 also performs various correction processes such as color correction and shading correction on the input image data. Image forming section 20 is controlled on the basis of the image data that has been subjected to these processes.

Image forming section 20 includes: toner image forming section 21 configured to form toner images of colored toners respectively containing a Y component, an M component, a C component, and a K component on the basis of the input image data; intermediate transfer unit transfer section 22 configured to transfer a toner image formed by toner image forming sections 21 to a sheet; fixing section 23 configured to fix a transferred toner image to a sheet; and the like.

Toner image forming section 21 includes four toner image forming sections 21Y, 21M, 21C, and 21K for the Y component, the M component, the C component, and the K component, respectively. Since toner image forming sections 21Y, 21M, 21C, and 21K have similar configurations, common elements are denoted by the same reference signs for ease of illustration and description. Only when elements need to be discriminated from one another, Y, M, C, K is added to their reference signs. In FIG. 3, reference signs are given to only the elements of toner image forming section 21Y for the Y component, and reference signs are omitted for the elements of other toner image forming sections 41M, 21C, and 21K.

Toner image forming section 21 includes exposing device 211, developing device 212, photoconductor drum 213, charging device 214, drum cleaning device 215 and the like.

Photoconductor drum 213 is, for example, a negative-charge-type organic photoconductor (OPC) formed by sequentially laminating an under coat layer (UCL), a charge generation layer (CGL), and a charge transport layer (CTL) on the circumferential surface of a conductive cylindrical body (aluminum-elementary tube) made of aluminum. The charge generation layer is made of an organic semiconductor in which a charge generating material (for example, phthalocyanine pigment) is dispersed in a resin binder (for example, polycarbonate), and generates a pair of positive charge and negative charge through light exposure by exposure device 211.

The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Charging device 214 is composed of a corona discharging generator such as a scorotron charging device and a corotron charging device, for example. Charging device 214 evenly negatively charges the surface of photoconductor drum 213 by corona discharge.

Exposing device 211 is composed of, for example, an LED print head including an LED array having a plurality of linearly laid out light-emitting diodes (LED), an LPH driving section (driver IC) for driving each LED, and an lens array that brings light radiated from the LED array into an image on photoconductor drum 213, and the like. Each of the LEDs of LED array 1 corresponds to one dot of an image. When the LPH driving section is controlled by control section 17, a predetermined driving current flows through the LED array, and designated LEDs emit light.

Exposure device 211 irradiates photoconductor drum 213 with light corresponding to the image of each color component. The positive charge generated in the charge generation layer of photoconductor drum 213 irradiated with light is transported to the surface of the charge transport layer, whereby the surface charge (negative charge) of photoconductor drum 213 is neutralized. Thus, an electrostatic latent image of each color component is formed on the surface of photoconductor drum 213 by the potential difference from its surroundings.

Developing device 212 stores developers of respective color components (for example, a two-component developer composed of toner and magnetic carrier). Developing device 212 attaches toner of respective color components to the surfaces of photoconductor drums 213, and visualizes the electrostatic latent image to form a toner image. To be more specific, a developing bias voltage is applied to a developer bearing member (developing roller), and an electric field is formed between photoconductor drum 213 and developer bearing member. By the potential difference between photoconductor drum 213 and the developer bearing member, the charging toner on the developer bearing member is caused to move and attach to a light exposure section on the surface of photoconductor drum 213.

Drum cleaning device 215 includes a drum cleaning blade that is brought into sliding contact with the surface of photoconductor drum 213, and removes residual toner that remains on the surface of photoconductor drum 213 after the primary transfer.

Intermediate transfer section 22 includes intermediate transfer belt 221, primary transfer roller 222, a plurality of support rollers 223, secondary transfer roller 224, belt cleaning device 225 and the like.

Intermediate transfer belt 221 is composed of an endless belt, and is stretched around the plurality of support rollers 223 in a loop form. At least one of the plurality of support rollers 223 is composed of a driving roller, and the others are each composed of a driven roller. When driving roller rotates, intermediate transfer belt 221 travels in arrow A direction at a constant speed.

Primary transfer rollers 222 are disposed on the inner periphery side of intermediate transfer belt 221 in such a manner as to face photoconductor drums 213 of respective color components. Primary transfer rollers 222 are brought into pressure contact with photoconductor drums 213 with intermediate transfer belt 221 therebetween, whereby a primary transfer nip (hereinafter referred to as "primary transfer section") for transferring a toner image from photoconductor drums 213 to intermediate transfer belt 221 is formed.

Secondary transfer roller 224 is disposed on the outer periphery side of intermediate transfer belt 221 in such a manner as to face one of support rollers 223. Support roller 223 that is so disposed as to face intermediate transfer belt 221 is called "backup roller."

Secondary transfer roller 224 is brought into pressure contact with the backup roller with intermediate transfer belt 221 therebetween, whereby a secondary transfer nip (hereinafter referred to as "secondary transfer section") for transferring a toner image from intermediate transfer belt 221 to a sheet is formed.

In the primary transfer section, the toner images on photoconductor drums 213 are sequentially primary-transferred to intermediate transfer belt 221. To be more specific, a primary transfer bias is applied to primary transfer rollers 222, and electric charge of the polarity opposite to the polarity of the toner is applied to the rear side (the side that makes contact with primary transfer rollers 222) of intermediate transfer belt 221, whereby the toner image is electrostatically transferred to intermediate transfer belt 221.

Thereafter, when the sheet passes through the secondary transfer section, the toner image on intermediate transfer belt 221 is secondary-transferred to the sheet. To be more specific, a secondary transfer bias is applied to secondary transfer roller 224, and an electric charge opposite to that of the toner is applied to the rear side (the side that makes contact with secondary transfer roller 224) of the sheet, whereby the toner image is electrostatically transferred to the sheet. The sheet on which the toner image has been transferred is conveyed toward fixing section 23.

Belt cleaning device 225 includes a belt cleaning blade configured to make sliding contact with the surface of intermediate transfer belt 221, and the like, and removes transfer residual toner remaining on the surface of intermediate transfer belt 221 after the secondary transfer.

Alternatively, in intermediate transfer section 22, it is also possible to adopt a configuration (so-called belt-type secondary transfer unit) in which a secondary transfer belt is installed in a stretched state in a loop form around a plurality of support rollers including a secondary transfer roller in place of secondary transfer roller 224.

Fixing section 23 includes upper fixing section 231 having a fixing side member disposed on a fixing surface (the surface on which a toner image is formed) side of a sheet, lower fixing section 232 having a back side supporting member disposed on the rear surface (the surface opposite to the fixing surface) side of a sheet, heating source 233 configured to heat the fixing side member, a pressure contact separation section (not illustrated) configured to bring the back side supporting member into pressure contact with the fixing side member, and the like.

For example, when upper fixing section 231 is of a roller heating type, the fixing roller serves as the fixing side member, and when upper fixing section 231 is of a belt heating type, the fixing belt serves as the fixing side member. In addition, for example, when lower fixing section 232 is of a roller pressing type, the pressure roller serves as the back side supporting member, and when lower fixing section 232 is of a belt pressing type, the pressing belt serves as the back side supporting member. FIG. 3 illustrates a configuration in which upper fixing section 231 is of a roller heating type, and lower fixing section 232 is of a roller pressing type.

Upper fixing section 231 includes upper fixing section-driving section (not illustrated) for rotating the fixing side member. When control section 17 controls the operation of the upper fixing section-driving section, the fixing side member rotates (travels) at a predetermined speed. Lower fixing section 232 includes lower fixing section-driving section (not illustrated) for rotating the back side supporting member. When control section 17 controls the operation of the lower fixing section-driving section, the back side supporting member rotates (travels) at a predetermined speed. It is to be noted that, in the case where the fixing side member follows the rotation of the back side supporting member, the upper fixing section-driving section is not required.

Heating source 233 is disposed inside or near the fixing side member. When control section 17 controls the output of heating source 233, the fixing side member is heated, and maintained at a predetermined temperature (for example, a fixable temperature, or a fixation idling temperature). On the basis of the detection result of a fixing temperature detection section (not illustrated) disposed at a position near the fixing side member, control section 17 controls the output of heating source 233.

A pressure contact separation section (not illustrated) presses the back side supporting member against the fixing side member. The pressure contact separation section makes contact with both ends of a shaft that supports the back side supporting member to separately press each end. With this structure, the balance of the nip pressure in the direction along the shaft in the fixing nip can be adjusted. When control section 17 controls the operation of the pressure contact separation section (not illustrated) such that the back side supporting member is brought into pressure contact with the fixing side member, a fixing nip for conveying a sheet in a tightly sandwiching manner is formed.

Heat and pressure are applied to a sheet on which a toner image has been secondary-transferred and which has been conveyed along a sheet feeding path at the time when the sheet passes through fixing section 23. Thus, the toner image is fixed to the sheet.

It is to be noted that fixing section 23 may include an air blowing section configured to apply air to the fixing side member or the back side supporting member in order to cool down the fixing side member or the back side supporting member, and in order to separate a sheet from the fixing side member or the back side supporting member.

Sheet feeding section 14 includes sheet feed tray section 141 and manual sheet feeding section 142. Flat sheets (standard type sheets and special type sheets) discriminated on the basis of their weight, size and the like are stored in sheet feed tray section 141 in advance on a predetermined type basis. A high-capacity external sheet feeding apparatus (not illustrated) can be connected to manual sheet feeding section 142. Sheet feeding section 14 sends a sheet fed from sheet feed tray section 141 or manual sheet feeding section 142 to sheet conveyance section 16.

Sheet ejection section 15 includes sheet ejection roller section 151 and the like, and ejects a sheet output by sheet conveyance section 16 out of the apparatus.

Sheet conveyance section 16 includes main conveyance section 161, switch-back conveyance section 162, rear surface printing conveyance section 163, sheet feeding path-switching section 164 and the like. For example, a part of sheet conveyance section 16 is incorporated in a unit together with fixing section 23, and is detachably mounted to image forming apparatus 1 (sheet conveyance unit ADU).

Main conveyance section 161 includes a plurality of conveyance roller sections including a loop roller section and a registration roller section which serve as sheet-conveyance elements for conveying sheets in a sandwiching manner. Main conveyance section 161 conveys a sheet fed from sheet-feed tray section 141 or manual sheet feeding section 142 to convey the sheet through image forming section 20 (secondary transfer section, fixing section 23), and conveys the sheet output from image forming section 20 (fixing section 23) toward sheet ejection section 15 or switch-back conveyance section 162.

Main conveyance section 161 includes the sheet feeding path in fixing section 23. In the following, in main conveyance section 161, a part of the fixing nip located on the downstream side in the sheet conveyance direction is referred to as "post-fixation conveyance section 30."

Switch-back conveyance section 162 temporarily stops a sheet output from fixing section 23, reverses the sheet in the conveyance direction, and conveys the sheet to sheet ejection section 15 or rear surface printing conveyance section 163.

Rear surface printing conveyance section 163 is a circulation path for conveying a sheet switchbacked at switch-back conveyance section 162 to main conveyance section 161. A sheet passes through main conveyance section 161 in a state where the second surface of the sheet faces upward.

Feeding-path-switching section 164 is disposed in post-fixation conveyance section 30, and configured to switch the sheet feeding paths according to whether a sheet output from fixing section 23 is ejected as it is, or is inverted before being ejected, or, is conveyed to rear surface printing conveyance section 163. To be more specific, control section 17 controls the operation of the conveyance path switching section 164 on the basis of the processing detail of the image formation process (one-side/duplex printing, face-up/face-down sheet ejection, and the like).

A sheet fed from sheet feeding section 14 is conveyed to image forming section 20 by main conveyance section 161. Thereafter, a toner image on intermediate transfer belt 221 is secondary-transferred to a first surface of the sheet at one time at the time when the sheet passes through the secondary transfer section, and then a fixing process is performed in fixing section 23. A sheet on which an image is formed is ejected out of the apparatus by sheet ejection section 15. When images are formed on both sides of a sheet, the sheet on which an image has been formed on its first surface is output to switch-back conveyance section 162, and then inverted by being returned to main conveyance section 161 through rear surface printing conveyance section 163 before an image is formed on its second surface.

Figure 5:
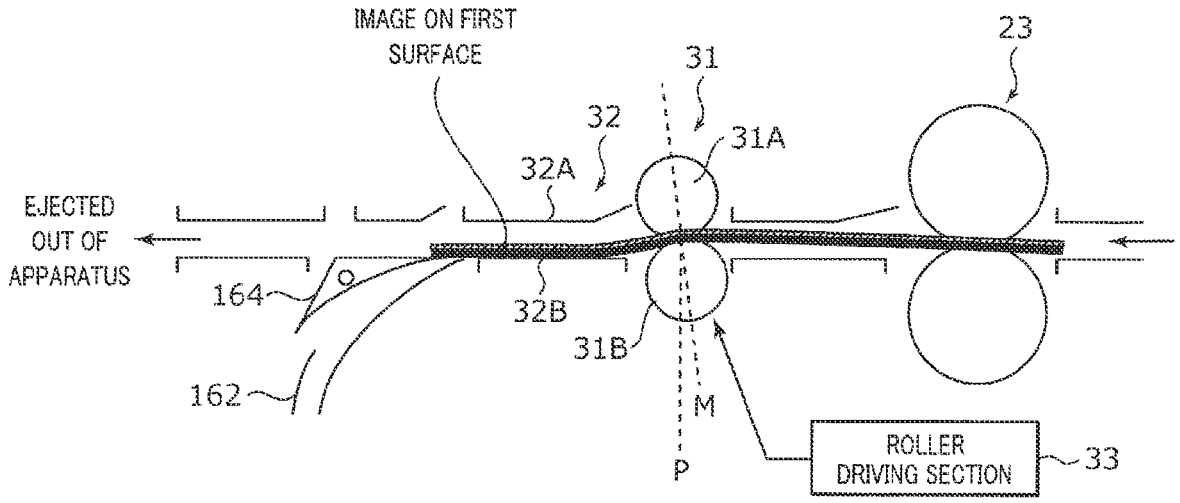
FIG. 5 illustrates a state of a post-fixation conveyance section at the time of one-side image formation.
Figure 6A:
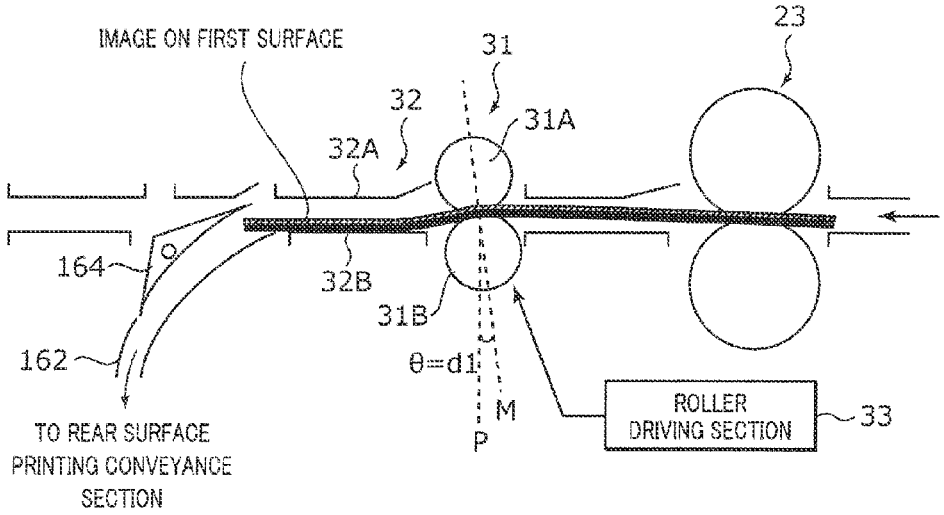
FIG. 6A illustrates a state of the post-fixation conveyance section when an image is formed on a first surface of a sheet.
Figure 6B:
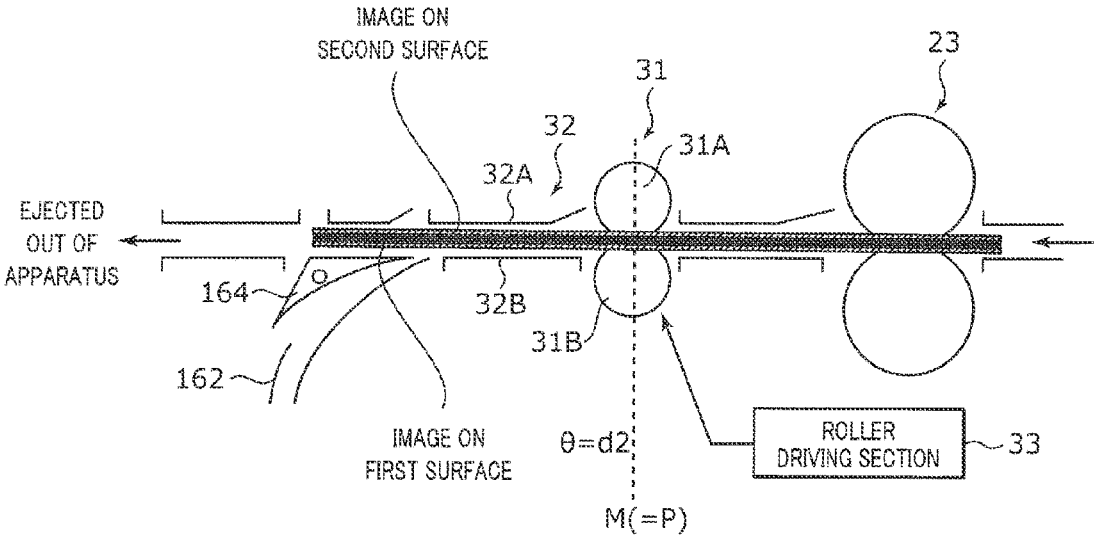
FIG. 6B illustrates a state of the post-fixation conveyance section when an image is formed on a second surface of a sheet.

FIG. 5 illustrates a state of post-fixation conveyance section 30 at the time of one-side image formation. FIGS. 6A and 6B illustrate a state of post-fixation conveyance section 30 at the time of duplex image formation. FIG. 6A illustrates a state of post-fixation conveyance section 30 in the case where an image is formed on the first surface of a sheet, and FIG. 6B illustrates a state of post-fixation conveyance section 30 in the case where an image is formed on the second surface of a sheet.

As illustrated in FIG. 5 and FIGS. 6A and 6B, post-fixation conveyance section 30 includes conveyance roller section 31 and conveyance guide section 32.

Conveyance guide section 32 includes first guide member 32A disposed on the fixing surface side of a sheet and second guide member 32B disposed on the rear surface side of a sheet. In this case, first guide member 32A and second guide member 32B are substantially horizontally disposed parallel to each other.

Conveyance roller section 31 includes a pair of rollers 31A and 31B. Conveyance roller section 31 is connected with roller driving section 33, and the installation angle relative to conveyance guide section 32 can be changed. When control section 17 controls the operation of roller driving section 33, conveyance roller section 31 is fixed in the state where a predetermined nip angle is held. Publicly known techniques (see, for example, Japanese Patent Application Laid-Open No. 10-319647) may be applied to roller driving section 33.

Typically, conveyance roller section 31 is disposed such that the output sheet is substantially parallel to second guide member 32B, that is, nip angle θ is 0° regardless of one-side image formation or duplex image formation.

In contrast, in the present embodiment, nip angle θ of conveyance roller section 31 can be changed according to whether the sheet on which an image has been formed on its first surface is conveyed, or the sheet on which an image has been formed on its second surface is conveyed.

For example, as illustrated in FIG. 5 and FIG. 6A, in the case where the sheet on which an image has been formed only on its first surface is conveyed, nip angle θ is set to first nip angle d1 configured to output the sheet toward sheet second guide member 32B. On the other hand, as illustrated in FIG. 6B, in the case where the sheet on which images have been formed on its first and second surfaces is conveyed, nip angle θ is set to second nip angle d2 configured to output the sheet such that the sheet is parallel to second guide member 32B.

In fixing section 23, the temperature of the fixing side member is higher than the temperature of the back side supporting member, and therefore a protruding (in this case, upward protruding) curl is easily formed on the fixing side (first guide member 32A side) of the sheet that has been subjected to fixation. Consequently, the image formation surface easily makes contact with first guide member 32A.

In view of this, in the case where the sheet on which an image has been formed only on its first surface is conveyed, the sheet is output toward second guide member 32B from conveyance roller section 31. As illustrated in FIG. 5, in the case of one-side image formation, the sheet output from conveyance roller section 31 is conveyed along second guide member 32B, and ejected out of the apparatus. In addition, as illustrated in FIG. 6A, in the case of duplex image formation, the sheet output from conveyance roller section 31 is conveyed along second guide member 32B, and output to switch-back conveyance section 162. The sheet is output in the state where the first surface, that is, the image formation surface, is not easily brought into contact with first guide member 32A, and thus scratch can be limited.

In the case of image formation on the second surface in duplex image formation, the possibility of scratch increases when the sheet is output toward second guide member 32B since the first surface on which an image has been firstly formed makes sliding contact with second guide member 32B. On the other hand, even when a curl is formed during fixation on the first surface, the curl is eliminated during fixation on the second surface, and therefore the sheet is brought back to the flat state.

Given the above, in the case where a sheet on which images have been formed on its first and second surfaces is conveyed, the sheet is output from conveyance roller section 31 such that the sheet is substantially parallel to second guide member 32B. The sheet is output in the state where the first and second surfaces as the image formation surfaces do not easily make contact with second guide member 32B and first guide member 32A, respectively, and thus scratch can be limited.

While nip angle θ is basically set to first nip angle d1 in the case where a sheet on which an image has been formed only on its first surface is conveyed as described above, nip angle θ may be set to second nip angle d2 in accordance with the possibility of scratch, or in accordance with the basis weight, conveyance speed, or presence/absence gloss of the sheet, for example. Thus, adjustment (change) of the nip angle is unnecessary in the case of duplex image formation, and consequently, conveyance roller section 31 can be easily controlled, and high-speed operation can be achieved.

Adjustment of the nip angle of conveyance roller section 31 is controlled by control section 17. To be more specific, control section 17 executes a nip angle setting process based on a flowchart shown in FIG. 7.

Figure 7:
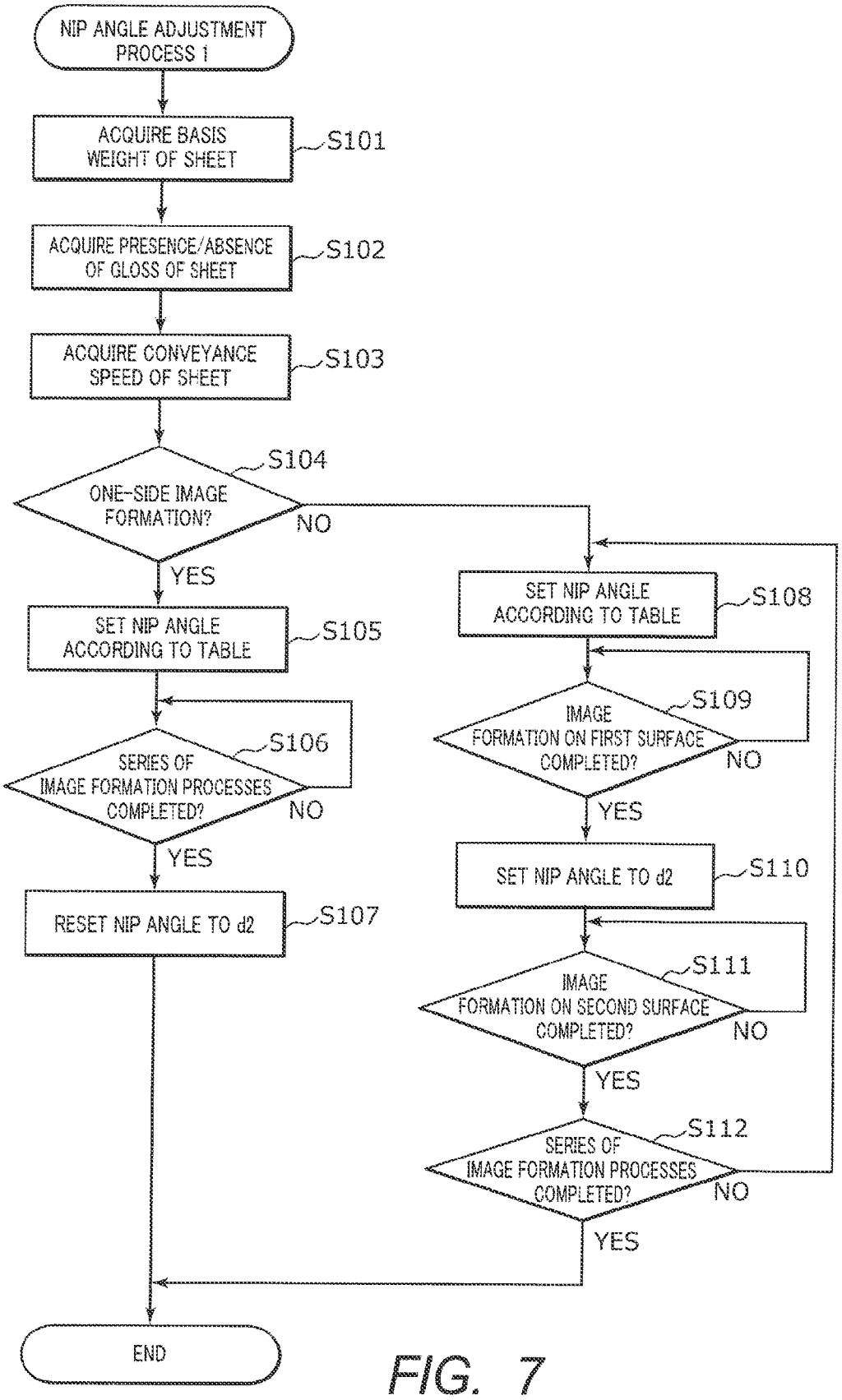
FIG. 7 is a flowchart of an exemplary nip angle adjustment process.

FIG. 7 is a flowchart showing an exemplary nip angle setting process. This process is achieved when CPU 171 executes a predetermined program stored in ROM 172 upon the start of an image formation process on a sheet in image forming apparatus 1 for example. Nip angle θ of conveyance roller section 31 is set to second nip angle d2 in the initial state.

At step S101, control section 17 acquires the basis weight of the sheet. Information relating to the basis weight of the sheet is set in advance by user operation (sheet setting) on operation display section 12.

At step S102, control section 17 acquires presence/absence of gloss of the sheet. Information relating to the presence/absence of gloss of the sheet is set in advance by user operation (sheet setting) on operation display section 12.

At step S103, control section 17 acquires the conveyance speed of the sheet. The information relating to the conveyance speed of the sheet is determined on the basis of the image formation conditions such as the type of the sheet and the image quality. On the basis of the information acquired at steps S101 to S103, nip angle θ of conveyance roller section 31 in the case where a sheet on which an image has been formed on its first surface is conveyed is determined.

At step S104, control section 17 determines whether the image formation process is one-side image formation. One-side image formation or duplex image formation is selected in advance by user operation (one-side/duplex setting) on operation display section 12. When the image formation process is one-side image formation ("YES" at step S104), the process is advanced to step S105. When the image formation process is duplex image formation ("NO" at step S104), the process is advanced to step S108.

At step S105, control section 17 sets the nip angle θ of conveyance roller section 31 to first nip angle d1 or second nip angle d2 on the basis of the information relating to the acquired basis weight, presence/absence of gloss, and conveyance speed of the sheet. The operation of roller driving section 33 is controlled such that nip angle θ is set to first nip angle d1 or second nip angle d2.

To be more specific, when setting nip angle θ, control section 17 refers to a nip angle control table such as that shown in Table 1. In the nip angle control table, conditions including the basis weight, presence/absence of gloss, and conveyance speed of the sheet, and nip angles (in this case, first nip angle d1 and second nip angle d2) suitable for the conditions are associated with each other.

TABLE 1

| Conveyance speed | Presence/absence of gloss | Basis weight (gsm) | Nip angle θ in image formation on first surface | Nip angle θ in image formation on second surface |
|---|---|---|---|---|
| $V_1$ | Non-coated sheet (without gloss) | 60 to 80 | d2 | d2 |
| | | 81 to 100 | | |
| | | 101 to 150 | d1 | |
| | | 151 to 200 | | |
| | | 201 to 250 | | |
| | | 251 to 350 | | |
| | Coated sheet (with gloss) | 60 to 80 | d1 | d2 |
| | | 80 to 100 | | |
| | | 101 to 150 | | |
| | | 151 to 200 | | |
| | | 201 to 250 | | |
| | | 251 to 350 | | |
| $V_1/2$ | Non-coated sheet (without gloss) | 60 to 80 | d2 | d2 |
| | | 80 to 100 | | |
| | | 101 to 150 | | |
| | | 151 to 200 | | |
| | | 201 to 250 | d1 | |
| | | 251 to 350 | | |
| | Coated sheet (with gloss) | 60 to 80 | d2 | d2 |
| | | 81 to 100 | d1 | |
| | | 101 to 150 | | |
| | | 151 to 200 | | |
| | | 201 to 250 | | |
| | | 251 to 350 | | |

According to Table 1, in the case where the conveyance speed is $V_1$ and a non-coated sheet (without gloss) is used, nip angle θ is set to second nip angle d2 when the basis weight of sheet is 60 to 100 gsm, and nip angle θ is set to first nip angle d1 when the basis weight is 101 to 350 gsm. In the case where the conveyance speed is $V_1$ and a coated sheet (with gloss) is used, nip angle θ is set to first nip angle d1 regardless of the basis weight of the sheet. In the case where the conveyance speed is $V_1/2$ (which is slower than V) and a non-coated sheet is used, nip angle θ is set to second nip angle d2 when the basis weight of the sheet is 60 to 200 gsm, and nip angle θ is set to first nip angle d1 when the basis weight of the sheet is 201 to 350 gsm. In the case where the conveyance speed is $V_1/2$ and a coated sheet is used, nip angle θ is set to second nip angle d2 when the basis weight of the sheet is 60 to 80 gsm, and nip angle θ is set to first nip angle d1 when the basis weight of the sheet is 81 to 350 gsm.

Regarding the conveyance speed of a sheet, the greater the conveyance speed, scratch is more likely to be caused. In addition, regarding the presence/absence of gloss of a sheet, a sheet provided with gloss (coated sheet) is more likely to cause scratch in comparison with a sheet not provided with gloss (non-coated sheet). Regarding the basis weight of a sheet, the greater the basis weight, the curl shape is more likely to be held.

The above-mentioned conditions are comprehensively determined, and when scratch is easily caused, nip angle θ is set to first nip angle d1 such that the image formation surface is separated from the guide member (in this case, first guide member 32A) which may make contact with the image formation surface. On the other hand, when scratch is not easily caused, it is not necessary to set nip angle θ to first nip angle d1, and if the sheet is output toward second guide member 32B, the end of the sheet may make contact with second guide member 32B, thus causing corner folding. Therefore, it is preferable to keep nip angle θ to second nip angle d2.

As described, in image forming apparatus 1, the nip angle adjusting section (control section 17 and roller driving section 33) selects first nip angle (d1) or second nip angle (d2) in accordance with the basis weight, conveyance speed, or presence/absence of gloss of the sheet to be conveyed in the case where a sheet on which an image has been formed on its first surface is conveyed. Since nip angle θ of conveyance roller section 31 is properly changed, it is possible to effectively limit scratch that is caused when the first surface as the image formation surface of the sheet makes contact with first guide member 32A.

At step S106, control section 17 determines whether a series of the image formation processes has been terminated. The series of image formation processes is processes for forming an image based on a signal requesting image formation (for example, printing job). When the series of image formation processes has been completed ("YES" at step S106), the process is advanced to step S107.

At step S107, control section 17 resets nip angle θ of conveyance roller section 31 to second nip angle d2 that is the initial setting, and terminates the nip angle adjustment process. It is to be noted that when nip angle θ of conveyance roller section 31 has not been changed, nip angle θ is kept as it is.

In the case of duplex image formation, at step S108, control section 17 sets nip angle θ of conveyance roller section 31 to first nip angle d1 or second nip angle d2 on the basis of the information relating to the acquired basis weight, presence/absence of gloss, and conveyance speed of the sheet, as with step S105 of one-side image formation.

At step S109, control section 17 determines whether image formation on the first surface of the sheet has been completed. For example, a sheet detection sensor (not illustrated, for example, a reflection type light sensor) is disposed near conveyance roller section 31, and whether image formation on the first surface of the sheet has been completed (whether the rear end of the sheet has passed through conveyance roller section 31) is determined on the basis of the result obtained by the sheet detection sensor. When the image formation on the first surface of the sheet has been completed ("YES" at step S109), the process is advanced to step S110.

The sheet on which an image has been formed on its first surface is conveyed through switch-back conveyance section 162 and rear surface printing conveyance section 163 to image forming section 20 in the state where its second surface is the image formation surface. In addition, feeding-path-switching section 164 switches the sheet feeding paths.

At step S110, control section 17 sets nip angle θ of conveyance roller section 31 to second nip angle d2. At step S108, when nip angle θ of conveyance roller section 31 is already set to second nip angle d2, nip angle θ is kept as it is. Since the sheet is separated from both of first guide member 32A and second guide member 32B when it is output, it is possible to effectively limit scratch that is caused when the first surface or second surface as the image formation surface makes contact with first guide member 32A or second guide member 32B.

At step S111, control section 17 determines whether image formation on the second surface of the sheet has been completed. When the image formation on the second surface of the sheet has been completed ("YES" at step S111), the process is advanced to step S112.

At step S112, control section 17 determines whether the series of image formation processes has been completed. When the series of image formation processes has been completed ("YES" at step S112), the nip angle adjustment process is terminated.

It is to be noted that while nip angle θ of conveyance roller section 31 is determined on the basis of the conveyance speed, presence/absence of gloss, and basis weight of sheet (steps S105 and S108) in the case where a sheet on which an image has been formed on its first surface is conveyed, the determination may be made on the basis of one or two of the conveyance speed, presence/absence of gloss, and basis weight of the sheet.

As described, image forming apparatus 1 according to the embodiment includes: toner image forming section (21) configured to form a toner image on image bearing member (221); transfer section (22) configured to transfer a toner image formed on image bearing member (221) to a sheet; fixing section (23) configured to fix a toner image transferred to a sheet by transfer section (22); conveyance roller section (31) including a pair of rollers (31A and 31B), and disposed on a downstream side of fixing section (23) in a sheet conveyance direction; conveyance guide section (32) including a first guide member (32A) disposed on a fixing side of a sheet and a second guide member (32B) disposed on a rear surface side of the sheet on the downstream side of conveyance roller section (31) in the sheet conveyance direction; feeding-path-switching section (164) configured to switch between a first sheet feeding path and a second sheet feeding path on the downstream side of conveyance guide section (32) in the sheet conveyance direction, the first sheet feeding path being configured to output a sheet from the apparatus, the second sheet feeding path being configured to output a sheet to rear surface printing conveyance section (163) provided continuously with second guide member (32B); and nip angle adjusting section (control section 17 and roller driving section 33) configured to change a nip angle of a conveyance nip formed by pair of rollers (31A and 31B) in accordance with whether a sheet on which an image is formed on a first surface thereof is conveyed, or a sheet on which an image is formed on a second surface thereof is conveyed.

To be more specific, nip angle adjusting section (control section 17 and roller driving section 33) sets nip angle (0) to first nip angle (d1) or a second nip angle (d2) when a sheet on which an image is formed on a first surface thereof is conveyed, whereas nip angle adjusting section (control section 17 and roller driving section 33) sets nip angle to second nip angle (d2) when an image is formed on a second surface thereof is conveyed, first nip angle (d1) being configured to output sheet toward second guide member (32B), second nip angle (d2) being configured to output the sheet such that the sheet is parallel to second guide member (32B).

With image forming apparatus 1, the direction of the sheet output from conveyance roller section 31 can be appropriately adjusted, and thus, without disposing a conveyance roller in a sheet feeding path, scratch can be limited, and high-quality images can be created.

[Modification]

In the embodiment, in the case where a sheet on which an image has been formed on its first surface is conveyed, the possibility of scratch is determined on the basis of the conveyance speed, presence/absence of gloss, or basis weight of the sheet. Alternatively, the possibility of scratch may be determined on the basis of the sheet pressure in the thickness direction of the sheet.

In the modification, a pressure detection section (not illustrated) is disposed on the upstream side of fixing section 23 in the sheet conveyance direction, and nip angle θ is determined on the basis of the sheet pressure in the thickness direction of the sheet. In this case, the nip angle adjustment process is performed in accordance with a flowchart shown in FIG. 8.

Figure 8:
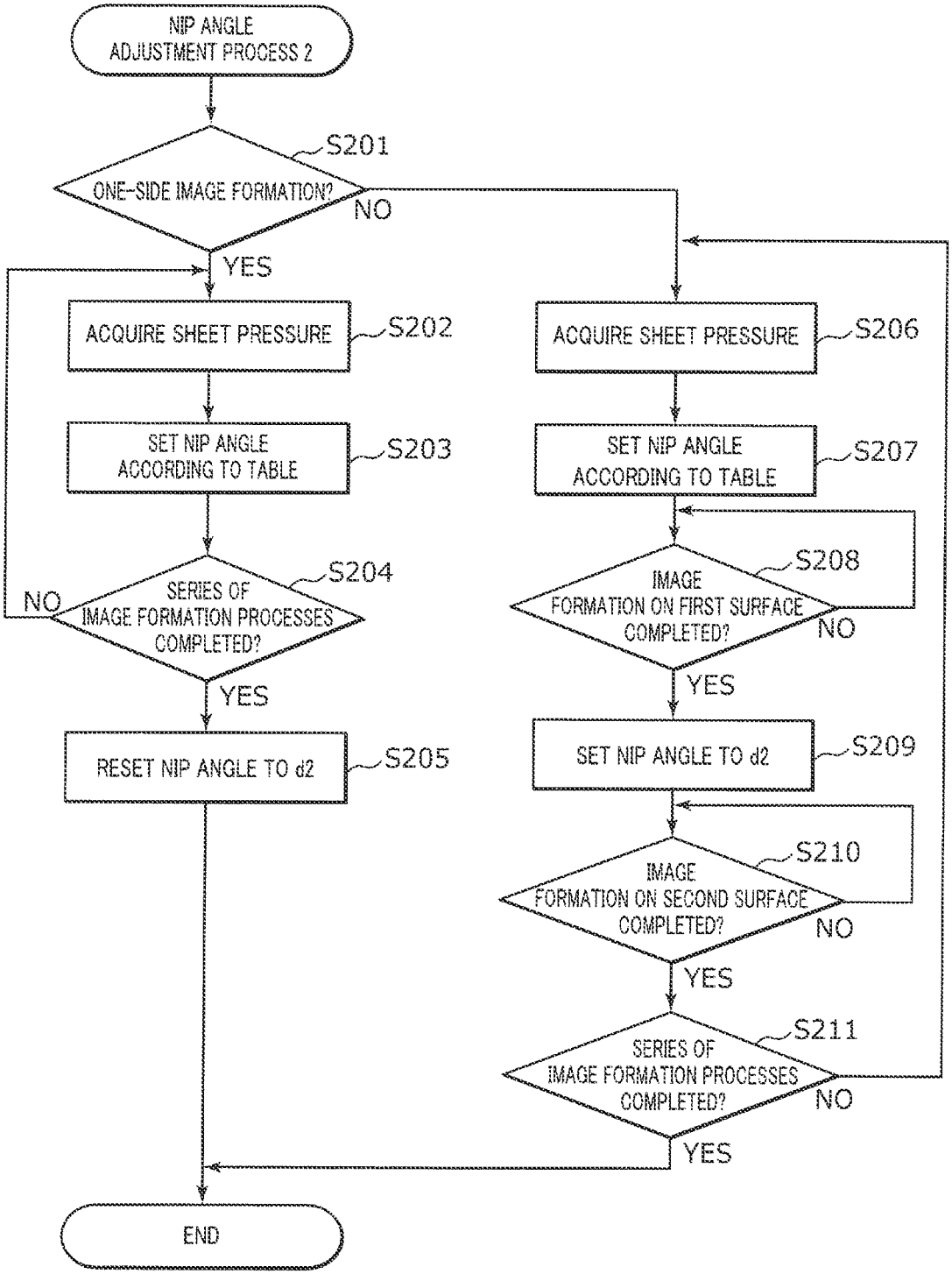
FIG. 8 is a flowchart of another exemplary nip angle adjustment process.

FIG. 8 is a flowchart of an exemplary nip angle setting process according to the modification. This process is achieved when CPU 171 executes a predetermined program stored in ROM 172 upon the start of an image formation process on a sheet in image forming apparatus 1 for example. Nip angle θ of conveyance roller section 31 is set to second nip angle d2 in the initial state.

At step S201, control section 17 determines whether the image formation process is one-side image formation. One-side image formation or duplex image formation is selected in advance by user operation (one-side/duplex setting) on operation display section 12. When the image formation process is one-side image formation ("YES" at step S201), the process is advanced to step S202. When the image formation process is duplex image formation ("NO" at step S201), the process is advanced to step S206.

At step S202, control section 17 acquires results (sheet pressure P) obtained by the pressure detection section (not illustrated).

At step S203, control section 17 sets nip angle θ of conveyance roller section 31 to first nip angle d1 or second nip angle d2 on the basis of the acquired sheet pressure P. The operation of roller driving section 33 is controlled such that nip angle θ is set to first nip angle d1 or second nip angle d2.

To be more specific, when setting nip angle θ, control section 17 refers to a nip angle control table such as that shown in Table 2. In the nip angle control table, sheet pressure P and nip angles (in this example, first nip angle d1 or second nip angle d2) are associated with each other.

TABLE 2

| Sheet pressure P | Nip angle θ in image formation on first surface | Nip angle θ in image formation on second surface |
|---|---|---|
| ≤P1 | d2 | d2 |
| >P1 | d1 | d2 |

According to Table 2, when sheet pressure P is equal to or smaller than a predetermined sheet pressure P1, it can be determined that scratch is not easily caused, and therefore nip angle θ is set to second nip angle d2. On the other hand, when sheet pressure P is greater than a predetermined sheet pressure P1, it can be determined that scratch is easily caused, and therefore nip angle θ is set to first nip angle d1.

As described, in image forming apparatus 1, the nip angle adjusting section (control section 17 and roller driving section 33) selects first nip angle (d1) or second nip angle (d2) in accordance with results (sheet pressure P) obtained by the pressure detection section in the case where a sheet on which an image has been formed on its first surface is conveyed. Since nip angle θ of conveyance roller section 31 is properly changed, it is possible to effectively limit scratch that is caused when the first surface as the image formation surface of the sheet makes contact with first guide member 32A.

At step S204, control section 17 determines whether the series of image formation processes has been completed. When series of image formation processes has been completed ("YES" at step S204), the process is advanced to step S205. When the series of image formation processes has not been completed ("NO" at step S204), the process is advanced to step S202, and the nip angle adjustment for the next sheet is performed.

At step S205, control section 17 resets nip angle θ of conveyance roller section 31 to second nip angle d2 that is the initial setting, and terminates the nip angle adjustment process. It is to be noted that when nip angle θ of conveyance roller section 31 has not been changed, nip angle θ is kept as it is.

In the case of duplex image formation, at step S206, control section 17 acquires results (sheet pressure P) obtained by the pressure detection section (not illustrated).

At step S207, control section 17 sets nip angle θ of conveyance roller section 31 to first nip angle d1 or second nip angle d2 on the basis of the acquired sheet pressure P, as with step S203 of one-side image formation.

At step S208, control section 17 determines whether image formation on the first surface of the sheet has been completed. When the image formation on the first surface of the sheet has been completed ("YES" at step S208), the process is advanced to step S209. The sheet on which an image has been formed on its first surface is conveyed through switch-back conveyance section 162 and rear surface printing conveyance section 163 to image forming section 20 in the state where its second surface is the image formation surface. In addition, feeding-path-switching section 164 switches the sheet feeding paths.

At step S209, control section 17 sets nip angle θ of conveyance roller section 31 to second nip angle d2. At step S206, when nip angle θ of conveyance roller section 31 is already set to second nip angle d2, nip angle θ is kept as it is. Since the sheet is separated from both of first guide member 32A and second guide member 32B when it is output, it is possible to effectively limit scratch that is caused when the first surface or second surface as the image formation surface makes contact with first guide member 32A or second guide member 32B.

At step S210, control section 17 determines whether image formation on the second surface of the sheet has been completed. When the image formation on the second surface of the sheet has been completed ("YES" at step S210), the process is advanced to step S211.

At step S211, control section 17 determines whether the series of image formation processes has been completed. When the series of image formation processes has been completed ("YES" at step S211), the nip angle adjustment process is terminated. When the series of image formation process has not been completed ("NO" at step S211), the process is advanced to step S206, and the nip angle adjustment for the next sheet is performed.

In the modification, the possibility of scratch is determined for each conveyed sheet on the basis of the sheet pressure, and thus the case where different sheets are used can be effectively handled. In addition, even in the case of sheet setting error by the user, nip angle θ of conveyance roller section 31 can be appropriately set. It is to be noted that nip angle θ may be determined using sheet pressure with the conveyance speed, presence/absence of gloss, or sheet basis weight of the sheet.

While the invention made by the present inventor has been specifically described based on the preferred embodiments, it is not intended to limit the present invention to the above-mentioned preferred embodiments but the present invention may be further modified within the scope and spirit of the invention defined by the appended claims.

For example, in the case where a sheet on which an image has been formed on its first surface is conveyed, nip angle θ of conveyance roller section 31 may be fixed to first nip angle d1 regardless of the conditions such as the sheet conveyance speed. In addition, in the case where nip angle θ of conveyance roller section 31 is set to first nip angle d1, first nip angle d1 may be changed stepwise in accordance with the possibility of scratch.

In addition, nip angle θ of conveyance roller section 31 may be adjusted by changing the installation angle of conveyance guide section 32 relative to conveyance roller section 31.

The embodiment disclosed herein is merely an exemplification and should not be considered as limitative. The scope of the present invention is specified by the following claims, not by the above-mentioned description.

It should be understood that various modifications, combinations, sub-combinations and alterations may occur depending on design requirements and other factors in so far as they are within the scope of the appended claims or the equivalents thereof.

What is claimed is:

1. An image forming apparatus comprising:

a toner image forming section configured to form a toner image on an image bearing member;

a transfer section configured to transfer a toner image formed on the image bearing member to a sheet;

a fixing section configured to fix a toner image transferred to a sheet by the transfer section;

a conveyance roller section including a pair of rollers, and disposed on a downstream side of the fixing section in a sheet conveyance direction;

a conveyance guide section disposed on a downstream side of the conveyance roller section in the sheet conveyance direction, and including a first guide member disposed on a fixing side of a sheet and a second guide member disposed on a rear surface side of the sheet;

a feeding-path-switching section disposed on a downstream side of the conveyance guide section in the sheet conveyance direction, and configured to switch between a first sheet feeding path and a second sheet feeding path, the first sheet feeding path being configured to output a sheet from the apparatus, the second sheet feeding path being configured to output a sheet to a rear surface printing conveyance section provided continuously with the second guide member;

a control section configured to determine whether an image is formed on only a first surface of the sheet or on both the first surface and a second surface of the sheet; and a nip angle adjusting section configured to set a nip angle of a conveyance nip formed by the pair of rollers to a first nip angle if the control section determines that an image is formed on only the first surface of the sheet, and to set the nip angle to a second nip angle if the control section determines that an image is formed on both the first surface and the second surface of the sheet, where the nip angle is an angle between a line P perpendicular to the second guide and a line M that connects axial centers of the pair of rollers, and where the line M forming the first nip angle is not parallel to the line M forming the second nip angle.

2. The image forming apparatus according to claim 1, wherein the nip angle adjusting section adjusts the nip angle by changing an installation angle of the conveyance roller section relative to the conveyance guide section.

3. The image forming apparatus according to claim 1, wherein the control section determines whether the image is formed on only a first surface of the sheet or on both the first surface and the second surface of the sheet based on a sheet setting input by a user.

4. An image forming apparatus comprising:

a toner image forming section configured to form a toner image on an image bearing member;

a transfer section configured to transfer a toner image formed on the image bearing member to a sheet;

a fixing section configured to fix a toner image transferred to the sheet by the transfer section;

a conveyance roller section including a pair of rollers, and disposed on a downstream side of the fixing section in the sheet conveyance direction;

a conveyance guide section disposed on a downstream side of the conveyance roller section in the sheet conveyance direction, and including a first guide member disposed on a fixing side of a sheet and a second guide member disposed on a rear surface side of the sheet;

a feeding-path-switching section disposed on a downstream side of the conveyance guide section in the sheet conveyance direction, and configured to switch between a first sheet feeding path and a second sheet feeding path, the first sheet feeding path being configured to output a sheet from the apparatus, the second sheet feeding path being configured to output a sheet to a rear surface printing conveyance section provided continuously with the second guide member;

a control section configured to determine whether an image is formed on only a first surface of the sheet or on both the first surface and a second surface of the sheet; and a nip angle adjusting section configured to set a nip angle of a conveyance nip formed by the pair of rollers to a first nip angle if the control section determines that an image is formed on only the first surface of the sheet, and to set the nip angle to a second nip angle if the control section determines that an image is formed on both of the first surface and the second surface of the sheet, wherein the first nip angle is set to output the sheet toward the second guide member and the second nip angle is set to output the sheet such that the sheet is parallel to the second guide member.

5. The image forming apparatus according to claim 4, wherein the nip angle adjusting section adjusts the nip angle by changing an installation angle of the conveyance roller section relative to the conveyance guide section.

6. The image forming apparatus according to claim 4, wherein the control section determines whether the image is formed on only a first surface of the sheet or on both the first surface and the second surface of the sheet based on a sheet setting input by a user.

* * * * *